United States Patent [19]

Geymayer et al.

[11] Patent Number: 4,563,294

[45] Date of Patent: Jan. 7, 1986

[54] AQUEOUS LUBRICANT FOR SAW CHAINS

[75] Inventors: Peter Geymayer; Erich Leidl, both of Burgkirchen, Fed. Rep. of Germany

[73] Assignee: Hoechst Aktiengesellschaft, Frankfurt am Main, Fed. Rep. of Germany

[21] Appl. No.: 478,698

[22] Filed: Mar. 25, 1983

[30] Foreign Application Priority Data

Mar. 27, 1982 [DE] Fed. Rep. of Germany ..... 3211352

[51] Int. Cl.[4] ..... C10M 3/04

[52] U.S. Cl. ..... 252/49.3; 252/33.3

[58] Field of Search ..... 252/49.3, 33.3

[56] References Cited

U.S. PATENT DOCUMENTS

| | | | |
|---|---|---|---|
| 2,825,693 | 3/1958 | Beaubien et al. | 252/49.3 X |
| 3,424,682 | 1/1969 | Sacerdote | 252/49.3 X |
| 3,833,502 | 9/1974 | Leary et al. | 252/49.3 X |
| 3,950,258 | 4/1976 | Imai et al. | 252/49.3 X |
| 3,980,571 | 9/1976 | Marx | 252/32.5 |
| 4,177,155 | 12/1979 | Popplewell | 252/49.3 |
| 4,250,046 | 2/1981 | Przybylinski | 252/49.3 |
| 4,414,125 | 11/1983 | Keil et al. | 252/75 |

FOREIGN PATENT DOCUMENTS

| | | | |
|---|---|---|---|
| 3123726 | 6/1981 | Fed. Rep. of Germany A | 252/51.5 |
| 1358902 | 7/1974 | United Kingdom . | |

*Primary Examiner*—William R. Dixon, Jr.
*Assistant Examiner*—Cynthia A. Prezlock
*Attorney, Agent, or Firm*—Curtis, Morris & Safford

[57] ABSTRACT

This saw chain lubricant is composed essentially of water and a water-soluble antifreeze agent, as main constituents, and of corrosion inhibitors, wear inhibitors and adhesion promoters in a quantity which is effective in each case, the adhesion promoter being a water-soluble polyethylene glycol and/or a water-soluble acrylamide copolymer which contains sulfonic acid groups, the molecular weight of each being at least 500,000. In combination with this adhesion promoter, which is present in an amount of 0.05 to 1% by weight, the lubricant contains 5 to 50% by weight of a water-soluble polyethylene oxide/polypropylene oxide adduct having a viscosity of at least 300 mPa.s at 50° C., as a special lubricant, percentages by weight relating in each case to the weight of the agent.

8 Claims, No Drawings

AQUEOUS LUBRICANT FOR SAW CHAINS

The invention relates to a lubricant for saw chains, which is composed essentially of water and a water-soluble antifreeze agent, as main constituents, and of corrosion inhibitors, wear inhibitors and adhesion promoters and which in particular ensures prolonged operation of the saw chain machine.

Lubricants based on mineral oil or synthetic products are in use for lubricating chain saws, such as are used, for example, in forestry for cutting trees. Lubricants of this type are also employed for lubricating stationary saws, such as mill saws. Although the lubricants based on mineral oil are satisfactory in respect of protection against wear and corrosion behavior, ecological objections are brought against them to an increasing extent, because by virtue of the mineral oil, they are not biodegradable. The known synthetic saw chain lubricants are composed essentially of water and a water-soluble antifreeze agent, preferably glycols, glycol ethers and/or trihydric aliphatic alcohols, such as glycerol, if appropriate together with monohydric, lower aliphatic alcohols, such as isopropanol, as main constituents. In addition to these main constituents, they contain corrosion inhibitors, wear inhibitors and adhesion promoters in a quantity which is effective in each particular case.

The corrosion-resistance additives and wear-resistance additives should, in particular, protect the chain links, the chain drive and the driving pinion against corrosion and wear. In some case so-called extreme pressure additives (EP additives) are also employed for this purpose. The adhesion additives should on the one hand have a viscosity-regulating effect and on the other hand should as far as possible prevent the lubricant from being whirled off the saw chain during operation. Effective prevention is particularly associated with the adhesion additive employed having the property of making the finished lubricant stringy.

Although the adhesion promoters used in the known saw chain lubricants composed of water and antifreeze agent as main constituents are capable of increasing the viscosity of the base constituents, they are precipitated during the operation of the saw chain machine, due to evaporation of water, as a result of which not only their viscosity-regulating action, but also their stringiness-imparting action is substantially lost. Finally, the adhesion additive is completely destroyed by the shear forces set up during operation. Accordingly, these known saw chain lubricants are not satisfactory, particularly in respect of viscosity behavior and adhesive action. Because of these disadvantages they do not make prolonged operation possible either.

The object of the invention is, therefore, to provide a lubricant, for saw chains, which is based on water and customary antifreeze agents and which does not have the disadvantages of the known agents of this type. The new saw chain lubricant is to have excellent properties not only in respect of corrosion-resistance and wear-resistance, but also, in particular, in respect of lubricating action, viscosity and adhesion. In addition, it is also to be fully effective even if the water evaporates partially or completely during the operation of the saw chain machine, and thus to ensure prolonged operation.

This object is achieved, in accordance with the invention, by means of a lubricant for saw chains, composed essentially of water and a water-soluble antifreeze agent, as main constituents, and of corrosion inhibitors, wear inhibitors and adhesion promoters, each in an effective amount, wherein the adhesion promoter is a water-soluble polyethylene glycol and/or a water-soluble acrylamide copolymer which contains sulfonic acid groups, the molecular weight of each being at least 500,000, in an amount of 0.05 to 1% by weight, relative to the weight of the lubricant, and the lubricant additionally contains 5 to 50% by weight, relative to the weight of the lubricant, of a water-soluble polyethylene oxide/polypropylene oxide adduct having a viscosity of at least 300 mPa.s at 50° C.

Surprisingly, the new saw chain lubricant possesses particularly good rheological properties, a strong lubricating action and an excellent adhesive power. It still acts in accordance with its function even if the water component evaporates during operation. These excellent properties may well be due, in particular, to the special combination of the adhesion promoters and polyethylene oxide/polypropylene oxide adducts which are present in accordance with the invention. These two components evidently complement one another to an unexpectedly high degree in respect of viscosity, lubrication, adhesion and rheological behavior of the agent, even when fractions of varying size of the main component water are no longer present.

The quantity of water (component A) in the agent according to the invention is generally 30 to 60% by weight, preferably 35 to 50% by weight, relative to the weight of the agent.

Any of the compounds which are also used in the known synthetic saw chain lubricants can be employed as the antifreeze (component B). Suitable antifreeze agents are (a) glycols, namely alkylene glycols having 2 to 6, preferably 2 to 4, carbon atoms, such as ethylene glycol, propylene glycol and butylene glycol, and oxalkylene glycols, preferably oxethylene and oxpropylene glycols having 4 to 14, preferably 4 to 10, carbon atoms, such as diethylene glycol, dipropylene glycol, triethylene glycol, tetraethylene glycol and tripropylene glycol, (b) aliphatic monoethers of the said glycols, preferably the monomethyl, monoethyl, monopropyl and monobutyl ethers, and (c) polyhydric aliphatic alcohols, preferably glycerol, erythritol and pentaerythritol. The glycols, glycol ethers and polyhydric alcohols can in each case be employed on their own or as a mixture. It is also possible, in addition to use other compounds which lower the freezing point, advantageously alkali metal and alkaline earth metal salts, preferably alkali metal carbonates, urea and monohydric aliphatic alcohols having 1 to 6, preferably 2 to 4, carbon atoms, such as ethanol and isopropanol. Amongst the said antifreeze agents, ethylene glycol (monoethylene glycol), propylene glycol, oxethylene glycols having 4 to 10 carbon atoms, such as diethylene glycol, triethylene glycol and tetraethylene glycol, and monomethyl, monoethyl, monopropyl and monobutyl ethers thereof, or mixtures thereof, if appropriate together with urea, in an amount of 1 to 10% by weight, relative to the weight of the antifreeze agent, are preferred. The amount of the antifreeze agent (component B) is generally 15 to 60% by weight, preferably 30 to 50% by weight, relative to the weight of the agent.

Suitable corrosion inhibitors (component C) and wear inhibitors (component D) are the compounds which are generally customary in this connection in the case of functional fluids based on water and glycols.

Accordingly, the following are suitable: (a) alkali metal salts of fatty acids having, preferably, 6 to 18 carbon atoms and of aliphatic or aromatic sulfonic acids in which the aliphatic radical is preferably an alkyl radical having more than 15 to 20 carbon atoms and the aromatic radical is preferably the benzene radical, for example the sodium or potassium salt of caproic acid, lauric acid, stearic acid, alkanesulfonic acids having more than 20 carbon atoms (petroleumsulfonate) and benzenesulfonamidocaproic acid; (b) alkali metal salts and esters of phosphorous acid, phosphoric acid, silicic acid and monothiophosphoric or dithiophosphoric acids with aliphatic alcohols having preferably 4 to 12 carbon atoms, for example sodium phosphite, sodium phosphate, waterglass and monoisopropyl and diisopropyl esters of phosphoric acid; (c) monoalkylamines and dialkylamines, if appropriate ethoxylated with 1 to 5 ethylene oxide units, and salts thereof with the acids mentioned under (a) and (b), the alkyl group in the amine having 1 to 18, preferably 4 to 12, carbon atoms, for example butylamine, hexylamine, octylamine, isononylamine, oleylamine, dibutylamine, dioctylamine and diisononylamine, and the salts of these amines with fatty acids having 6 to 18 carbon atoms, phosphoric acid, phosphorous acid and benzenesulfonamidocaproic acid; (d) alkanolamines, if appropriate ethoxylated with 1 to 5 ethylene oxide units, and salts thereof with the acids mentioned under (a) and (b), the alkyl group in the alkanol having 2 to 6 carbon atoms, for example monoethanolamine, diethanolamine or triethanolamine, and the salts of these alkanolamines with fatty acids having 6 to 18 carbon atoms, phosphoric acid, phosphorous acid and benzenesulfonamidocaproic acid; (e) molybdenum and antimony compounds, preferably in the form of dithiocarbamates; (f) chloroparaffins and (g) molybdenum sulfide dispersions and graphite dispersions. Protection against both corrosion and wear is achieved by means of the said compounds (on their own or mixed with one another). Further suitable compounds, which can be used, in particular, as protection against corrosion, are alkali metal salts of boric acid and triazoles, preferably benztriazole.

The wear inhibitors employed are preferably the alkali metal salts of fatty acids having 6 to 18 carbon atoms, alkali metal salts of phosphoric acid, the salts of monoalkylamines having 4 to 12 carbon atoms in the alkyl group and of monoethanolamine, diethanolamine and triethanolamine with fatty acids having 6 to 18 carbon atoms and with phosphoric acid, and the molybdenum compounds.

The corrosion inhibitors employed are preferably the alkali metal salts of alkanesulfonic acids having more than 20 carbon atoms (petroleumsulfonate), alkali metal salts of phosphoric acid, waterglass, the salts of monoalkylamines having 4 to 12 carbon atoms in the alkyl group and of monoethanolamine, diethanolamine and triethanolamine with phosphoric acid and with benzenesulfonamidocaproic acid, and benztriazole.

The amount of corrosion inhibitor (component C) and wear inhibitor (component D) is generally 0.5 to 5% by weight, preferably 1 to 3% by weight, relative to the weight of the agent.

The adhesion promoters (component E) employed in accordance with the invention are water-soluble polyethylene glycols having a molecular weight of at least 500,000, preferably 1,000,000 to 10,000,000 and particularly 5,000,000 to 7,000,000. These solid polyethylene glycols are known and are commercially available, as a rule in the form of powders. Further adhesion promoters which can be used in accordance with the invention are water-soluble acrylamide copolymers having a molecular weight of at least 500,000, preferably 1,000,000 to 10,000,000 and particularly 5,000,000 to 7,000,000, the comonomer in the copolymer containing a sulfonic acid group (one $SO_3H$ group per comonomer unit). The comonomer (acrylamide being the other monomer) is preferably 2-acrylamido-2-methylpropanesulfonic acid. A preferred acrylamide copolymer is accordingly composed of acrylamide and 2-acrylamido-2-methylpropanesulfonic acid. The amount of comonomer is generally 10 to 80% by weight, preferably 50 to 70% by weight, relative to the copolymer.

The amount of adhesion promoter is generally 0.05 to 1% by weight, preferably 0.1 to 0.5% by weight, relative to the weight of the agent.

The new saw chain lubricant contains, in accordance with the invention, a special lubricant (component F), namely liquid and water-soluble polyethylene oxide/polypropylene oxide adducts having a viscosity of at least 300 mPa.s, preferably 1,000 to 20,000 and particularly 3,000 to 12,000, mPa.s (measured at 50° C. as specified in DIN 53,018 using a rotational viscometer). These polyethylene oxide/polypropylene oxide adducts are known and available commercially. They are statistical ethylene oxide/propylene oxide polyadducts which have the viscosity indicated. In the ethylene oxide/propylene oxide polymers selected in accordance with the invention (in which the ethylene oxide and propylene oxide units are in a statistical distribution) the ratio of ethylene oxide to propylene oxide is generally 1:3 to 5:1, preferably 1:1 to 4:1.

The polyethylene oxide/polypropylene oxide adducts to be used in accordance with the invention are prepared, as is known, by adding on ethylene oxide and propylene oxide to compounds containing active hydrogen atoms, preferably in the form of hydroxyl groups or primary or secondary amine groups. Suitable starting compounds are: (a) water; (b) monohydric, saturated aliphatic alcohols having preferably 1 to 4 carbon atoms, such as methanol, ethanol, isopropanol and butanol; (c) dihydric, saturated aliphatic alcohols, preferably alkylene glycols having 2 to 4 carbon atoms, and oxalkylene glycols having 2 to 10 carbon atoms, such as ethylene glycol, propylene glycol, butylene glycol, diethylene glycol, dipropylene glycol and triethylene glycol; (d) trihydric and polyhydric, saturated aliphatic alcohols having preferably 3 to 6 carbon atoms, such as glycerol, erythritol, pentaerythritol, trimethylolethane, trimethylolpropane, sorbitol and mannitol; (e) saturated aliphatic amines having, preferably, 1 to 6 carbon atoms, such as ethylamine, isopropylamine, butylamine, dibutylamine and propylenediamine; (f) saturated aliphatic alkanolamines having, preferably, 2 to 6 carbon atoms, such as monoethanolamine and diethanolamine; and (g) ethoxylates or propoxylates formed from the said compounds (a) to (f). Mixtures of the said compounds (a) to (g) can also be employed as starting compounds for an addition reaction with ethylene oxide and propylene oxide until an adduct which is liquid and water-soluble and has the viscosity indicated, is achieved.

The amount of polyethylene oxide/polypropylene oxide adduct (component F) is generally 5 to 50% by weight, preferably 10 to 30% by weight, relative to the weight of the agent.

The liquid saw chain lubricant according to the invention is prepared by mixing the individual components together. This is advantageously carried out in a container equipped with a stirrer, the components being advantageously introduced successively at room temperature and mixed with stirring.

The invention will now be illustrated in greater detail by means of examples.

EXAMPLE 1

The quantities indicated in column 1 in Table I below of the individual components of a lubricant according to the invention are mixed at room temperature. This is effected by initially taking diethylene glycol and then stirring into this the polyethylene glycol of molecular weight 5,000,000, followed by the water, after which the suspension present is allowed to stand until it has swollen completely. The remaining components are then added, again with stirring. The resulting lubricant has the properties listed in column 1 of Table II below.

EXAMPLES 2 TO 9

The procedure followed in these examples is analogous to that of Example 1, and the lubricants, according to the invention, indicated in columns 2 to 9 of Table I are obtained. They have the properties listed in columns 2 to 9 of Table II.

COMPARISON EXAMPLE

Table II shows the properties of a synthetic saw chain lubricant corresponding to the state of the art.

As can be seen from Table II, the lubricant according to the invention has a much more advantageous viscosity, compared with the known lubricant. It also exhibits, even at high shear rates, an advantageous viscosity behavior, which is particularly important for use in accordance with the definition. The adhesion promoter employed in accordance with the invention remains fully effective even after the water has evaporated, whereas the adhesion promoter present in the comparison example loses its stringiness-imparting action relatively rapidly. In contrast with the known lubricant, the lubricant according to the invention also has an excellent anti-wear action.

TABLE I

| Components | Example No. 1 | 2 | 3 | 4 | 5 | 6 | 7 | 8 | 9 |
|---|---|---|---|---|---|---|---|---|---|
| Water | 40.00 | 40.00 | 60.00 | 40.00 | 40.00 | 40.00 | 40.00 | 40.00 | 40.00 |
| Diethylene glycol | 47.45 | 18.45 | 18.45 | — | — | 48.15 | 47.75 | 45.85 | 46.45 |
| Triethylene glycol monomethyl ether | — | — | — | — | 47.45 | — | — | — | — |
| Tetraethylene glycol monomethyl ether | — | — | — | 48.45 | — | — | — | — | — |
| Urea | — | — | 5.00 | — | — | — | — | — | — |
| Sodium C > 20-alkanesulfonate | — | — | — | — | — | — | 0.40 | — | — |
| Waterglass | — | — | — | — | — | — | — | 0.10 | — |
| Benztriazole | 0.05 | 0.05 | 0.05 | 0.05 | 0.05 | 0.05 | 0.05 | 0.05 | 0.05 |
| Triethanolamine benzenesulfonamidocaproate | 1.00 | 1.00 | 1.00 | 1.00 | 1.00 | 1.00 | — | — | — |
| Triethanolamine | — | — | — | — | — | — | 0.50 | — | — |
| Triethanolamine phosphate | 0.40 | 0.40 | 0.40 | 0.40 | 0.40 | 0.40 | — | — | — |
| Potassium phosphate | — | — | — | — | — | — | 0.20 | 2.80 | 2.30 |
| Polyethylene glycol, molecular weight 5,000,000 | 0.10 | 0.10 | 0.10 | 0.10 | 0.10 | — | 0.10 | 0.20 | — |
| Polyethylene glycol, molecular weight 500,000 | — | — | — | — | — | 0.40 | — | — | — |
| Copolymer formed from 50% by weight of acrylamide and 50% by weight of 2-acrylamido-2-methylpropanesulfonic acid | — | — | — | — | — | — | — | — | 0.20 |
| 4:1 polyethylene oxide/polypropylene oxide adduct, viscosity 300 mPa · s at 50° C. | — | 40.00 | — | — | — | — | — | — | — |
| 4:1 polyethylene oxide/polypropylene oxide adduct, viscosity 12,000 mPa · s at 50° C. | 11.00 | — | 15.00 | 10.00 | 11.00 | 10.00 | 11.00 | 11.00 | 11.00 |

TABLE II

| Properties | Example No. 1 | 2 | 3 | 4 | 5 | 6 | 7 | 8 | 9 | Comparison |
|---|---|---|---|---|---|---|---|---|---|---|
| Viscosity (mPa · s) measured as specified in DIN 53,018 | | | | | | | | | | |
| at +20° C. | 108 | 133 | 75 | 88 | 124 | 95 | 100 | 130 | 190 | 51 |
| and at +40° C. | 48 | 55 | 39 | 38 | 54 | 41 | 45 | 59 | 80 | 37 |
| or as specified in DIN 53,019 at +20° C. and 10,000 seconds$^{-1}$ | 65 | 78 | 155 | 58 | 69 | 70 | 80 | 78 | 72 | 23 |
| Freezing point (°C.) | −25 | −23 | −17 | −36 | −18 | −25 | −24 | −25 | −25 | −17 |
| Four-ball apparatus; welding lead as specified in DIN 51,350 (N) | 2200/2400 | 2200/2400 | 1600/2400 | 2200/2400 | 2200/2400 | 2200/2400 | 1600/1800 | 4000/4200 | 3800/4000 | 3600/3800 |
| Four-ball apparatus; hour's run at 400 N loading as specified in | 1.05 | 0.71 | 1.16 | 1.25 | 0.92 | 1.06 | 0.85 | 1.20 | 1.29 | 1.26 |

TABLE II-continued

| Properties | Example No. 1 | 2 | 3 | 4 | 5 | 6 | 7 | 8 | 9 | Comparison |
|---|---|---|---|---|---|---|---|---|---|---|
| DIN 51,350 (mm) Adhesive action after 1 hour at 110° C. in ratings 1-3*) | 1 | 1 | 2 | 1 | 1 | 1 | 2 | 1 | 1 | 3 |

*1 = very good (strong stringiness imparting action), 2 = good (stringiness-imparting action), 3 = poor (nostringiness-imparting action, solid deposits).

We claim:

1. A lubricant for saw chains consisting essentially of
(A) 30 to 60 percent by weight water,
(B) 15 to 60 percent by weight of a water-soluble antifreeze agent selected from the group consisting of alkylene glycols having 2 to 6 carbon atoms and oxalkylene glycols having 4 to 14 carbon atoms,
(C)+(D) 0.5 to 5 percent by weight of a corrosion inhibitor and a wear inhibitor,
(E) 0.05 to 1 percent by weight of an adhesion promoter having a molecular weight of at least 500,000, selected from the group consisting of water-soluble polyethylene glycol and water-soluble acrylamide copolymer which contains sulfonic acid groups, and
(F) 5 to 50 percent by weight of a water-soluble polyethylene oxide/polypropylene oxide adduct having a viscosity of 1,000 to 20,000 mPa.s at 50° C.

2. A lubricant as claimed in claim 1, wherein the molecular weight of the adhesion promoter is 1 million to 10 million.

3. A lubricant as claimed in claim 1, wherein the molecular weight of the adhesion promoter is 5 to 7 million.

4. A lubricant as claimed in claim 1, wherein the amount of adhesion promoter is 0.1 to 0.5% by weight.

5. A lubricant as claimed in claim 1, wherein the viscosity of the adduct is 3,000 to 12,000 mPa.s.

6. A lubricant as claimed in claim 1, wherein the amount of adduct is 10 to 30% by weight.

7. A lubricant as claimed in claim 1, wherein the acrylamide copolymer is composed of acrylamide and 2-acrylamido-2-methylpropanesulfonic acid.

8. A lubricant as claimed in claim 1, having the components (A) to (F) in the following amounts:
(A) 35 to 50
(B) 30 to 50
(C)+(D) 1 to 3
(E) 0.1 to 0.5
(F) 10 to 30.

* * * * *